US007100604B2

(12) United States Patent
Gurnee et al.

(10) Patent No.: US 7,100,604 B2
(45) Date of Patent: Sep. 5, 2006

(54) LATCHING SYSTEM AND METHOD FOR PRESSURE CHAMBERS

(75) Inventors: William T. Gurnee, La Jolla, CA (US); Juan Jose Garay, San Diego, CA (US)

(73) Assignee: Oxyheal Health Group, LaJolla, CA (US)

( * ) Notice: Subject to any disclaimer, the term of this patent is extended or adjusted under 35 U.S.C. 154(b) by 0 days.

(21) Appl. No.: 10/865,499

(22) Filed: Jun. 10, 2004

(65) Prior Publication Data

US 2005/0161039 A1 Jul. 28, 2005

Related U.S. Application Data

(60) Provisional application No. 60/478,214, filed on Jun. 13, 2003.

(51) Int. Cl.
*A61G 10/00* (2006.01)

(52) U.S. Cl. ..... 128/202.12; 128/205.26

(58) Field of Classification Search ..... 128/205.26, 128/202.12; 600/21, 22
See application file for complete search history.

(56) References Cited

U.S. PATENT DOCUMENTS

| | | | | |
|---|---|---|---|---|
| 4,227,524 | A * | 10/1980 | Galerne | 128/205.26 |
| 4,991,255 | A * | 2/1991 | Liu | 16/70 |
| 5,193,431 | A * | 3/1993 | Propsting et al. | 92/21 MR |
| 5,350,230 | A * | 9/1994 | Ray | 366/75 |
| 5,503,143 | A | 4/1996 | Marion et al. | |
| 6,230,921 | B1 * | 5/2001 | Berglund | 220/319 |
| 6,535,382 | B1 * | 3/2003 | Bishop et al. | 361/690 |

* cited by examiner

*Primary Examiner*—Henry Bennett
*Assistant Examiner*—Andrew Bunin
(74) *Attorney, Agent, or Firm*—Foley & Lardner LLP

(57) ABSTRACT

A latching mechanism for a pressure chamber for hypobaric use is disclosed. The mechanism includes one or more pin modules positioned on a periphery of a door of the pressure chamber, the door being adapted to open into the chamber and abut a frame of the pressure chamber when the door is in a closed position. The mechanism further includes an actuator for selectively engaging or disengaging the pin with the frame. The pin module may include a pin adapted to be selectively positioned in an engaged or a disengaged position. The pin in the engaged position extends from the door to the frame of the pressure chamber, thereby preventing the door from opening into the chamber. The pin module includes a cylinder for actuating the pin. The cylinder may be a pneumatic cylinder operated with pneumatic pressure. The pneumatic cylinder of each of the pin modules may be centrally actuated.

17 Claims, 3 Drawing Sheets

LATCHING SYSTEM AND METHOD FOR PRESSURE CHAMBERS

This application is related to U.S. Provisional Patent Application No. 60/478,214, filed Jun. 13, 2003, from which priority is claimed, and which is hereby incorporated by reference in its entirety including all tables, figures and claims.

FIELD OF THE INVENTION

The invention relates, in general, to pressure chambers. More particularly, the invention provides latching systems and methods for pressure vessels for human occupancy, such as hypobaric chambers used for altitude simulation.

BACKGROUND

The following discussion of the background of the invention is merely provided to aid the reader in understanding the invention and is not admitted to describe or constitute prior art to the present invention.

Hyperbaric chambers have been regularly used in many applications, including medical applications. For example, hyperbaric chambers have been used for hyperbaric oxygen therapy for treating many medical conditions and for training regimens such as the treatment of severe burns, peripheral vascular disease, carbon monoxide poisoning, decompression illness and the like. Pressure in hyperbaric chambers can be varied from atmospheric pressure to a desired level greater than atmospheric pressure.

Hyperbaric chambers generally include at least one entry into the chamber. These entries may or may not include an airlock. Known entries include a door swings into the chamber to open. Thus, when closed, the door is pressed against the inside of the frame of the chamber. In this configuration, the pressure inside the chamber facilitates the sealing of the door. In other words, since the pressure inside the chamber is greater than that outside the chamber, the door is further pressed against the inside of the frame of the chamber to secure the door in the closed position and make a pressure-tight seal.

In contrast to hyperbaric chambers, hypobaric pressure chambers allow a low-pressure or vacuum-like environment to be maintained within the chamber. Hypobaric chambers can be useful in many applications such as simulation of high-altitude environments which may be experienced by, for example, pilots or astronauts.

Hypobaric chambers typically include an entry door that swings outward so that the pressure differential causes the door to be pulled against the frame of the chamber. One such hypobaric chamber is illustrated in U.S. Pat. No. 5,503,143.

Although hypobaric chambers have a significant number of applications, the cost of building a hypobaric chamber to meet acceptable standards can be prohibitive. Rather, it would be preferable to provide a way to use a chamber designed for hyperbaric applications as a hypobaric chamber or a dual-use (hyperbaric/hypobaric) pressure chamber.

SUMMARY OF THE INVENTION

The disclosed devices are directed to systems and methods of latching hyperbaric chambers. The chambers may then be adapted to be used as hypobaric or hyperbaric chambers.

In one aspect, the invention provides a pressure chamber for hypobaric use. The chamber includes a pressure chamber and a door adapted to open into the chamber. The door abuts a frame of the pressure chamber when the door is in a closed position. One or more latching modules are provided. The latching modules are adapted to prevent the door from opening into the chamber when the latching modules are activated.

In one embodiment, the latching modules include a pin module positioned on a periphery of the door. The pin module includes a pin adapted to be selectively positioned in an engaged or a disengaged position. The pin in the engaged position extends from the door to the frame of the pressure chamber, thereby preventing the door from opening into the chamber.

In another aspect, the invention provides a latching mechanism for a pressure chamber for hypobaric use. The mechanism includes one or more pin modules positioned on a periphery of a door of the pressure chamber, the door being adapted to open into the chamber and abut a frame of the pressure chamber when the door is in a closed position. The mechanism further includes an actuator for selectively engaging or disengaging the pin with the frame. In a preferred embodiment, the pin module includes a pin adapted to be selectively positioned in an engaged or a disengaged position. The pin in the engaged position extends from the door to the frame of the pressure chamber, thereby preventing the door from opening into the chamber.

In one embodiment, the pin module includes a cylinder for actuating the pin. The cylinder may be a pneumatic cylinder operated with pneumatic pressure. The pneumatic cylinder of each of the pin modules may be centrally actuated.

In one embodiment, a seal plate is mounted on the frame at a position corresponding to a position of the pin module. The seal plate includes a proximity sensor to detect engagement of the pin. A safety module may be adapted to receive signals from each proximity sensor. The safety module may be further adapted to prevent operation of the chamber unless all proximity sensors detect engagement of a corresponding pin.

BRIEF DESCRIPTION OF THE DRAWINGS

In the following, the invention will be explained in further detail with reference to the drawings, in which.

DESCRIPTION OF CERTAIN EMBODIMENTS OF THE INVENTION

The disclosed embodiments of the present invention provide a latching system and method for use with pressure chambers. In particular, the systems and methods of the present invention allow the use of a hyperbaric chamber as a hypobaric chamber and thus a dual-use chamber (hyperbaric/hypobaric chamber).

Figure 1:
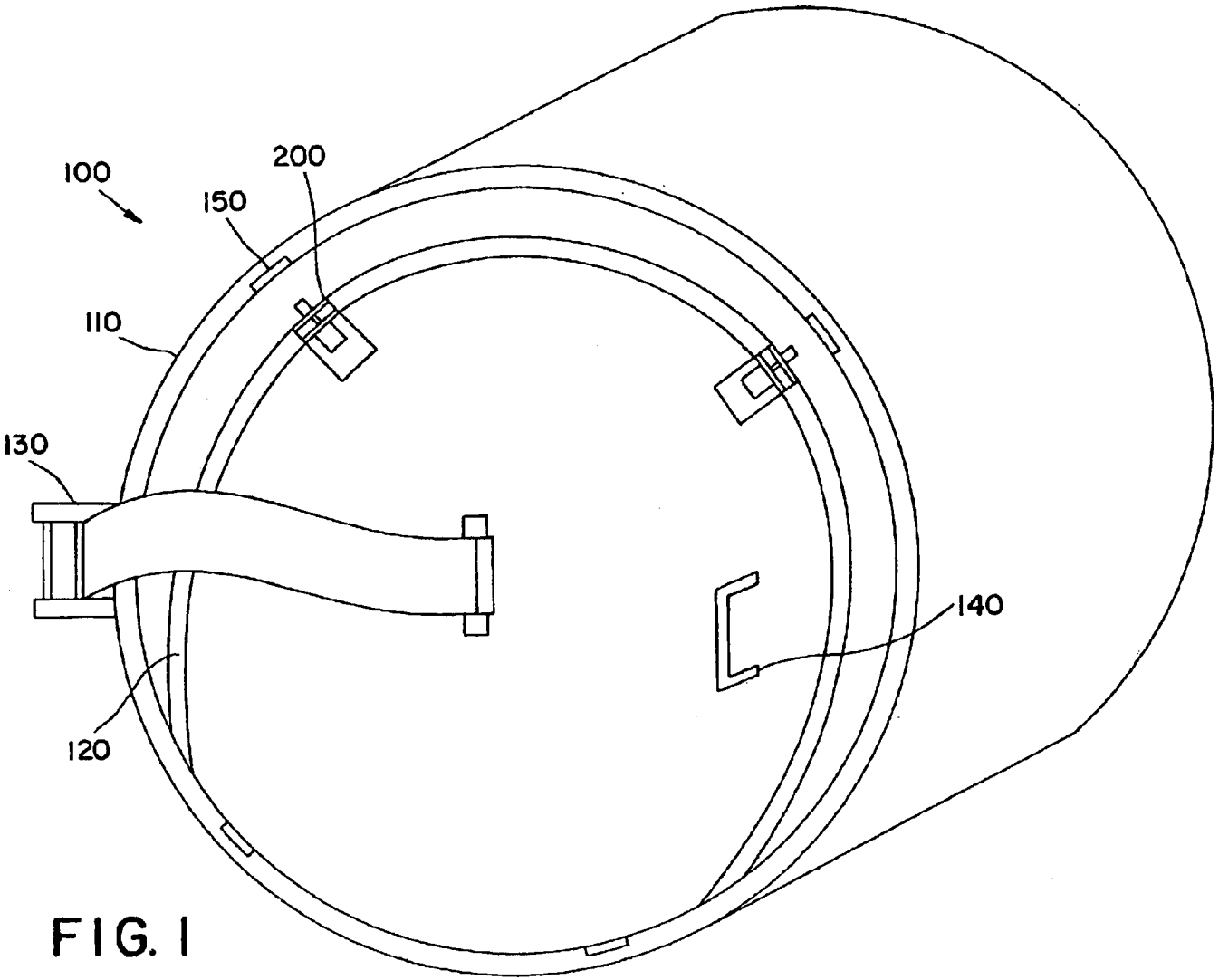
FIG. 1 illustrates an embodiment of an entry for a hypobaric chamber according to the present invention.

FIG. 1 illustrates one embodiment of a chamber entry according to the present invention. The chamber 100 includes a chamber frame 110 which forms the body of the pressure chamber. The frame 110 is preferably made of steel and built to standards and guidelines, for example, promulgated by American Society of Mechanical Engineers (ASME). One exemplary pressure chamber is described in U.S. patent application Ser. No. 10/087,042, titled "HYPERBARIC OXYGEN THERAPY SYSTEM CONTROLS", filed Feb. 28, 2002, which is hereby incorporated by reference in its entirety.

A door 120 is provided to allow entry by a human into the chamber 100. The door 120 is adapted to swing inward into the chamber 100. In this regard, the door pivots about a hinge 130 connected to the frame 110 of the chamber 100. One or more handles 140 may be provided on the door to facilitate opening and closing of the chamber. A seal may be provided between the door 120 and the frame 110 to assure a secure closure door.

The door 120 and the chamber frame 110 may be designed and manufactured for use as a hyperbaric chamber. In this regard, when the pressure inside the chamber 100 is greater than the pressure outside the chamber 100, the pressure differential facilitates closure of the door 120 and the sealing of the chamber 100.

On the other hand, when the chamber 100 is used as a hypobaric chamber, the pressure inside the chamber 100 is less than the pressure outside the chamber 100. In this case, the pressure differential tends to pull the door 120 away from the frame 110 and, therefore, impedes closure of the door 120 and sealing of the chamber 100. To counter this tendency, the door 120 of the embodiment illustrated in FIG. 1 is provided with a plurality of pin modules 200. The pin modules 200 engage the outside of the frame 110 when the door is closed and a hypobaric seal is desired. Seal plates 150 are provided on the outside of the frame 110 to facilitate this engagement. The seal plates 150 may also serve as sensors to engagement of the pin modules 200 to the frame 110.

The number of pin modules 200 provided on the door 120 may be dictated by several factors. For example, the number of modules 200 depends on the strength of each pin module 200 and the pressure differential between the outside and inside environments. Further, the number of modules 200 is dictated by the level of sealing required between the door 120 and the frame 110. For example, a perfect seal requires a small arc between pin modules 120, whereas a low sealing requirement may allow a much larger arc.

Figure 2:
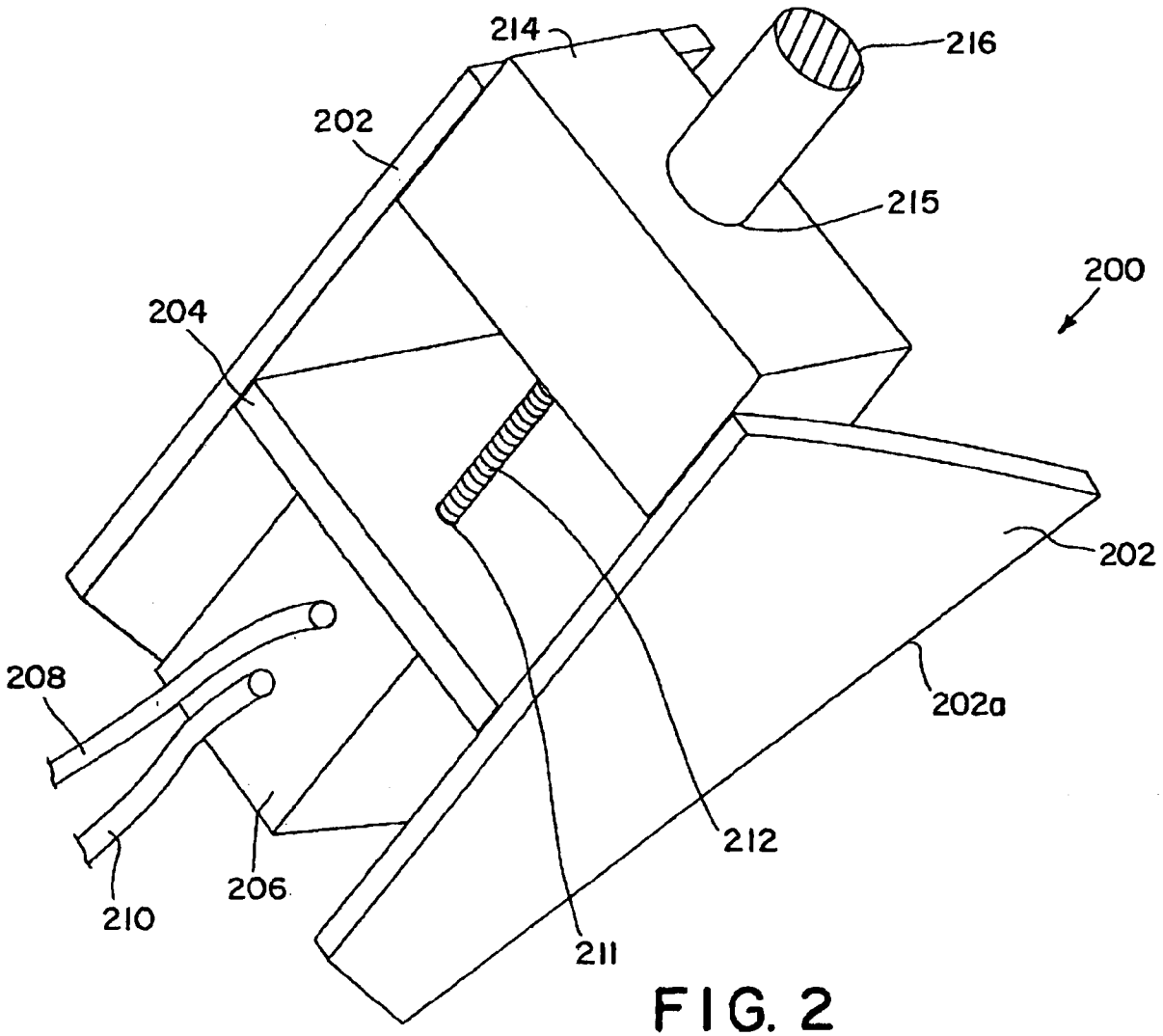
FIG. 2 illustrates an embodiment of a pin module for use with the hypobaric chamber entry illustrated in FIG. 1.

FIG. 2 illustrates one embodiment of a pin module 200 according to the present invention. The pin module 200 includes a pair of mounting plates 202 for mounting the pin module 200 to the door 120. In this regard, the mounting plates 202 extend perpendicularly from the outer surface of the door 120. The bottom edges 202*a* of the plates 202 may be welded onto the door 120. In other embodiments, the plates 202 and other components of the pin module 200 may be integrally formed with the door 120. The plates 202 are preferably made of steel, preferably SA 516 grade 70 having a Code allowable tension stress of 20,000 psi.

A cross plate 204 is provided between the two mounting plates 202. The cross plate 204 is positioned substantially perpendicular to the door 120 and the mounting plates 202. The cross plate 204 is preferably made of the same material as the mounting plates 202.

A pneumatic cylinder 206 is mounted onto one side of the cross plate 204. The pneumatic cylinder 206 includes a piston 212 which is actuated by supply and exhaust lines 208, 210. As described below with reference to FIG. 3, supply and exhaust pneumatic lines may be centrally controlled for all pin modules 200. The cylinder 206 is mounted radially inward of the cross plate 204 when the pin module 200 is mounted to the door 120. The cross plate 204 is provided with a through hole 211 through which the piston 212 can extend and retract when actuated.

Although pneumatic controls are provided in the illustrated embodiment, it will be understood by those skilled in the art that other control mechanisms may also be employed. For medical uses, pneumatics provide a safe and compliant mechanism.

The pneumatic cylinder 206 is sized to provide sufficient strength to force a pin 216 into an engagement position. The pin 216 is made of steel, preferably SA 564 grade 630, temper H1150. In one embodiment, the pin 216 is 1.5 inches in diameter. The pin 216 is guided through a through hole 215 in a block 214 which traverses the mounting plates 202. The block 214 is preferably made of the same material as the mounting plates 202. The pin 216 is attached to the piston 212 using fasteners such as bolts.

In the embodiment illustrated in FIG. 1, a pin module such as the one illustrated in FIG. 2 is mounted at 90-degree intervals. Thus, four pin modules 200 are used to secure the door 120 for hypobaric use of the chamber 100.

In one embodiment, each of two ends of the chamber 100 is provided with a door 120.

Both doors are provided with pin modules for securing the chamber for hypobaric use.

Figure 3:
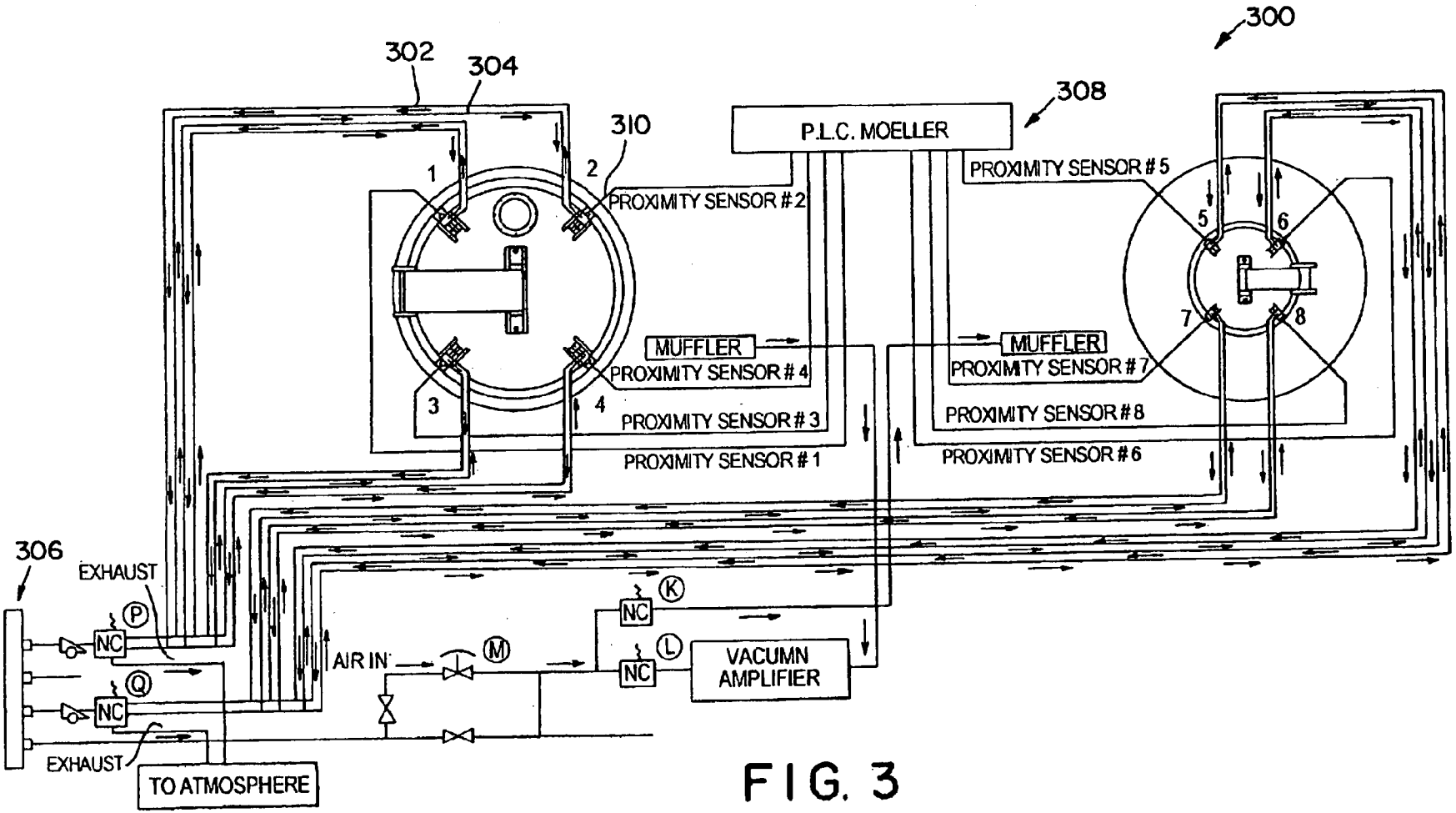
FIG. 3 is a schematic illustration of an embodiment of a hypobaric chamber latching system according to the present invention.

FIG. 3 is a schematic illustration of one embodiment of a control system for use with the chamber described above. The embodiment illustrated in FIG. 3 includes controls for a chamber having two doors. It will be understood by those skilled in the art that the arrangement can be reduced for use with a single-door arrangement or extended for an arrangement with more than two doors.

The arrangement 300 includes pneumatic lines from a common source 306 leading to each pin module. Each pin module is associated with a pair of pneumatic lines, a supply line 302 and an exhaust line 304. The pneumatic lines 302, 304 actuate the pneumatic cylinder 206 (see FIG. 2) of each pin module. At the common source 306, an operator may control the pneumatic pressure to either engage or disengage all of the pin modules with the chamber frame. As noted above, mechanisms other than pneumatic pressure may be used to actuate the pin modules, but pneumatics are preferable for compliance with medical applications.

For safety purposes, a proximity sensor 310 may be installed at each pin module. The proximity sensor may be positioned with the seal plates 150 (see FIG. 1) mounted on the chamber frame. The proximity sensor 310 may be adapted to detect the presence of the pin 216 at or near the seal plate 150. Thus, when the pin module engages the chamber frame (or the seal plate 150), the proximity sensor 310 detects such engagement. In this regard, a safety feature of the arrangement 300 may prevent evacuation of the chamber to a low pressure environment unless all proximity sensors 310 detect an engagement of the pin module to the chamber frame. Signals from each proximity sensor 310 may be directed to a control module 308 for such determination.

In addition to the pin modules, an O-ring may be positioned between the door and the chamber frame. The O-ring provides an air-tight pressure seal between the inside of the chamber and the external environment. The O-ring may be seated in a pressurized seat to ensure a seal when the chamber is used as a hypobaric or a hyperbaric chamber. Pressure for the O-ring seal may be supplied through the same pneumatic system as the one used for the actuation of the pin modules. One embodiment of such an O-ring arrangement is illustrated in FIGS. 12A and 12B of in U.S. patent application Ser. No. 10/087,042, titled "HYPERBARIC OXYGEN THERAPY SYSTEM CONTROLS", filed Feb. 28, 2002, which has been incorporated by reference in its entirety.

Thus, the present invention allows a chamber such as a hyperbaric chamber to be adapted for use as a hypobaric chamber or a dual-use chamber without significant additional expense.

While particular embodiments of the present invention have been disclosed, it is to be understood that various different modifications and combinations are possible and are contemplated within the true spirit and scope of the appended claims. There is no intention, therefore, of limitations to the exact abstract or disclosure herein presented.

What is claimed is:

1. A pressure chamber system comprising:

a pressure chamber configured to provide a hyperbaric environment and a hypobaric environment, wherein pressure within said pressure chamber in the hyperbaric environment is greater than atmospheric pressure and pressure within said pressure chamber in the hypobaric environment is less then atmospheric pressure;

a door adapted to open into said pressure chamber, said door abutting a frame of said pressure chamber when said door is in a closed position;

one or more latching modules configured to couple said door to said frame;

wherein said one or more latching modules prevent said door from opening into said pressure chamber when said latching modules are activated and when said pressure chamber provides the hypobaric environment;

wherein said door is pressed against said frame when said pressure chamber provides the hyperbaric environment.

2. The pressure chamber system according to claim 1, wherein each of said one or more latching modules comprises:

a pin module positioned on a periphery of said door, wherein said pin module includes a pin adapted to be selectively positioned in an engaged or a disengaged position, wherein said pin in said engaged position extends from said door to said frame of said pressure chamber thereby preventing said door from opening into said chamber.

3. The pressure chamber system according to claim 2, wherein said pin module includes a cylinder for actuating said pin.

4. The pressure chamber system according to claim 3, wherein said cylinder is a pneumatic cylinder operated with pneumatic pressure.

5. The pressure chamber system according to claim 4, wherein said pneumatic cylinder of each of said pin modules is centrally actuated.

6. The pressure chamber system according to claim 2, wherein said latching module further includes a seal plate mounted on said frame at a position corresponding to a position of said pin module, said seal plate including a proximity sensor to detect engagement of said pin.

7. The pressure chamber system according to claim 6, further comprising a safety module adapted to receive signals from each proximity sensor.

8. The pressure chamber system according to claim 7, wherein said safety module is further adapted to prevent operation of said chamber unless all proximity sensors detect engagement of a corresponding pin.

9. A latching mechanism for a pressure chamber configured for hypobaric use and for hyperbaric use, comprising:

one or more pin modules positioned on a periphery of a door of said pressure chamber, said door being adapted to open into said chamber and abut a frame of said pressure chamber when said door is in a closed position; and an actuator for selectively engaging or disengaging said pin with said frame;

wherein the actuator selectively engages said pin with said frame to prevent said door from opening into said pressure chamber at least when the pressure chamber is configured for hypobaric use;

wherein said door is pressed against said frame at least when the pressure chamber is configured for hyperbaric use.

10. The latching mechanism according to claim 9, wherein said pin module includes a pin adapted to be selectively positioned in an engaged or a disengaged position, wherein said pin in said engaged position extends from said door to said frame of said pressure chamber thereby preventing said door from opening into said chamber.

11. The latching mechanism according to claim 10, wherein said pin module includes a cylinder for actuating said pin.

12. The latching mechanism according to claim 11, wherein said cylinder is a pneumatic cylinder operated with pneumatic pressure.

13. The latching mechanism according to claim 12, wherein said pneumatic cylinder of each of said pin modules is centrally actuated.

14. The latching mechanism according to claim 10, wherein said latching module further includes a seal plate mounted on said frame at a position corresponding to a position of said pin module, said seal plate including a proximity sensor to detect engagement of said pin.

15. The latching mechanism according to claim 14, further comprising a safety module adapted to receive signals from each proximity sensor.

16. The latching mechanism according to claim 15, wherein said safety module is further adapted to prevent operation of said chamber unless all proximity sensors detect engagement of a corresponding pin.

17. A pressure chamber system comprising:

a pressure chamber capable of providing both a hyperbaric environment and a hypobaric environment, wherein pressure within the pressure chamber in the hyperbaric environment is greater than atmospheric pressure anti pressure within the pressure chamber in the hypobaric environment is less ten atmospheric pressure;

a door movable into the pressure chamber, the door abutting a frame of the pressure chamber when the door is in a closed position;

one or more latching modules to couple the door to the frame and includes a pin module and a seal plate, wherein the seal plate is mounted on the frame at a position corresponding to a position of the pin module and includes a proximity sensor to detect engagement of the pin, wherein the pin module is positioned on a periphery of the door and includes a pin selectively positionable in a disengaged position or an engaged position where the pin extends from the door to the frame of the pressure chamber and prevents the door from opening into the chamber;

wherein the one or more latching modules prevent the door from opening into the pressure chamber when the latching modules are activated and when the pressure chamber provides the hypobaric environment;

wherein the door is pressed against the frame when the pressure chamber provides the hyperbaric environment.

* * * * *

UNITED STATES PATENT AND TRADEMARK OFFICE

CERTIFICATE OF CORRECTION

PATENT NO. : 7,100,604 B2
APPLICATION NO. : 10/865499
DATED : September 5, 2006
INVENTOR(S) : William T. Gurneé and Juan Jose Garay It is certified that error appears in the above-identified patent and that said Letters Patent is hereby corrected as shown below:

Column 6:
line 40, replace “anti” with --and--.

Column 6:
line 41, replace “ten” with --than--.

Signed and Sealed this

Sixth Day of March, 2007

JON W. DUDAS
*Director of the United States Patent and Trademark Office*